US005120147A

United States Patent [19]

Ozaki

[11] Patent Number: 5,120,147

[45] Date of Patent: Jun. 9, 1992

[54] PRINTING DEVICE

[75] Inventor: Yuichi Ozaki, Nagoya, Japan

[73] Assignee: Brother Kogyo Kabushiki Kaisha, Aichi, Japan

[21] Appl. No.: 534,190

[22] Filed: Jun. 6, 1990

[30] Foreign Application Priority Data

Jun. 9, 1989 [JP] Japan ..... 1-67448[U]
Aug. 23, 1989 [JP] Japan ..... 1-98086[U]

[51] Int. Cl.[5] ..... B41J 11/20
[52] U.S. Cl. ..... 400/649; 400/692; 400/691; 400/120
[58] Field of Search ..... 400/120, 208, 208.1, 400/207, 648, 649, 650, 654, 655, 691, 692, 693, 693.1

[56] References Cited

U.S. PATENT DOCUMENTS 4,402,619 9/1983 Paque et al. .
4,419,175 12/1983 Bradshaw et al. .
4,557,617 12/1985 Richardson et al. .
4,575,267 3/1986 Brull ..... 400/655
4,632,577 12/1986 Brull et al. ..... 400/649
4,697,940 10/1987 Bradshaw et al. ..... 400/655
4,815,871 3/1989 McGourty et al. ..... 400/120
4,832,514 5/1989 Basile ..... 400/208
4,966,476 10/1990 Kuzuya et al. ..... 400/208

FOREIGN PATENT DOCUMENTS 272232 6/1988 European Pat. Off. .
279570 12/1986 Japan ..... 400/655
2162794A 2/1986 United Kingdom .
2223740A 4/1990 United Kingdom .
2224485A 5/1990 United Kingdom .

*Primary Examiner*—David A. Wiecking
*Assistant Examiner*—Joseph R. Keating
*Attorney, Agent, or Firm*—Kane, Dalsimer, Sullivan, Kurucz, Levy, Eisele and Richard

[57] ABSTRACT

In a printing device utilizing a printing tape on which a printing operation is executed and including a printing member for executing the desired printing operations on the printing tape and a case member arranged to be attachably and detachably mounted on the printing device for housing the printing tape on which the printing operation is not executed in a wounded state, provided are a member for supporting a platen member on which the printing tape is located when the printing operation is to be executed, the printing tape being arranged to be fed between the platen member and the printing member; and means for the supporting member so as to be moved between a first position in which the printing tape is nipped by the printing member and the platen member and a second position in which the nipping operation of the printing tape is released. Thus, it becomes easy to replace the printing tape with preventing an occurrence of damages of the printing tape.

14 Claims, 5 Drawing Sheets

PRINTING DEVICE

Background of the Invention

The present invention relates to a printing device for printing character and/or symbol data on a printing tape, and more particularly to a printing device arranged in such a manner that the printing tape is easily changed.

Conventionally, a printing devices for printing data on a printing tape, for cutting the tape on which the data have been printed in a predetermined length, and for sticking the tape on a target substance, have been widely known.

However, in the conventional printing devices, by attaching a rolled blank tape to a tape attaching section of the printing device, the printing tape is newly attached. In attaching the tape, the leading edge of the printing tape should be passed to the printing section in which data are printed on the printing tape. Thus, when attaching the printing tape to the printing device, a plurality of operation steps which require taking care of correct order. In addition, the rolled printing tape is inconvenient to handle.

Summary of the Invention

It is therefore an object of the present invention is to provide an improved printing device in which a replacing operation of the printing tape may simply be executed without a mistake by employing a tape holding case for holding the printing tape therein.

Another object of the invention is to provide an improved printing device in which the tape holding case is easily detached from the printing device after a case cover for covering the tape holding case is detached from the printing device.

Further object of the invention is to provide an improved printing mechanism, including at least a printing member and a platen member, arranged in such a manner that at least one of said printing member and said platen member is movable between a printing position and a non-printing position, whereby it becomes easy to replace a printing tape on condition that the printing mechanism is located at the non-printing position.

For this purpose, according to one aspect of the invention, there is provided a printing device, capable of utilizing at least a printing tape on which a printing operation is executed, including a printing member for executing the desired printing operations on said printing tape, and a case member arranged to be attachably and detachably mounted on said printing device for housing at least said printing tape on which the printing operation is not executed in a wound state, said printing device further comprising:

supporting means for supporting a platen member on which said printing tape is located when the printing operation is to be executed, said printing tape being arranged to be fed between said platen member and said printing member; and controlling means for controlling said supporting means so as to be moved at least between a first position in which said printing tape is nipped by said printing member and said platen member and a second position in which the nipping operation of said printing tape is released.

According to another aspect of the invention, there is provided a printing device, capable of utilizing at least a printing tape on which a printing operation is executed, including a printing member for executing the desired printing operations on said printing tape, and a case member arranged to be attachably and detachably mounted on said printing device for housing at least said printing tape on which the printing operation is not executed in a wound state, said printing device further comprising:

supporting means for supporting a platen member on which said printing tape is located when the printing operation is to be executed, said printing tape being arranged to be fed between said platen member and said printing member;

controlling means for controlling said supporting means so as to be moved at least between a first position in which said printing tape is nipped by said printing member and said platen member and a second position in which the nipping operation of said printing tape is released; and another controlling means, arranged to be attachably and detachably provided on said printing device, for controlling said supporting means so as to be located at said second position when said another controlling means is detached from said printing device.

According to further aspect of the invention, there is provided a printing mechanism, comprising at least a printing member and a platen member between which a printing medium is located when a printing operation is executed, for executing a printing operation on said printing medium, said printing mechanism further comprising:

supporting means for supporting one of said printing member and said platen member; and controlling means for controlling said supporting means so as to be moved between at least a first position in which said printing medium is nipped by said printing member and said platen member and a second position in which the nipping operation of said printing medium is released.

DESCRIPTION OF THE ACCOMPANYING DRAWINGS

DESCRIPTION OF THE EMBODIMENTS

Figure 1:
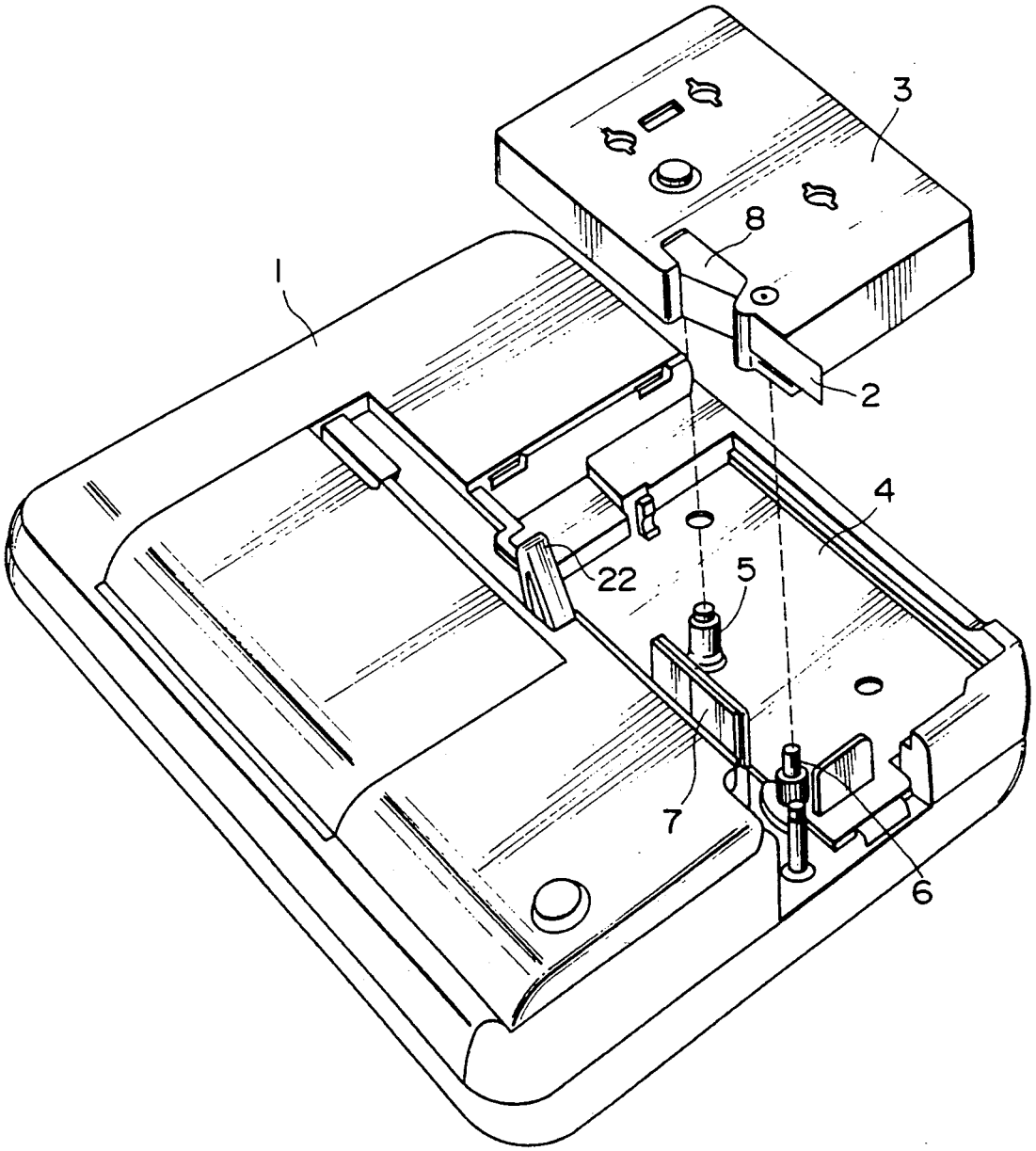
FIG. 1 is a perspective view on the rear side of the printing device according to the present invention, where the case cover is removed.
Figure 2:
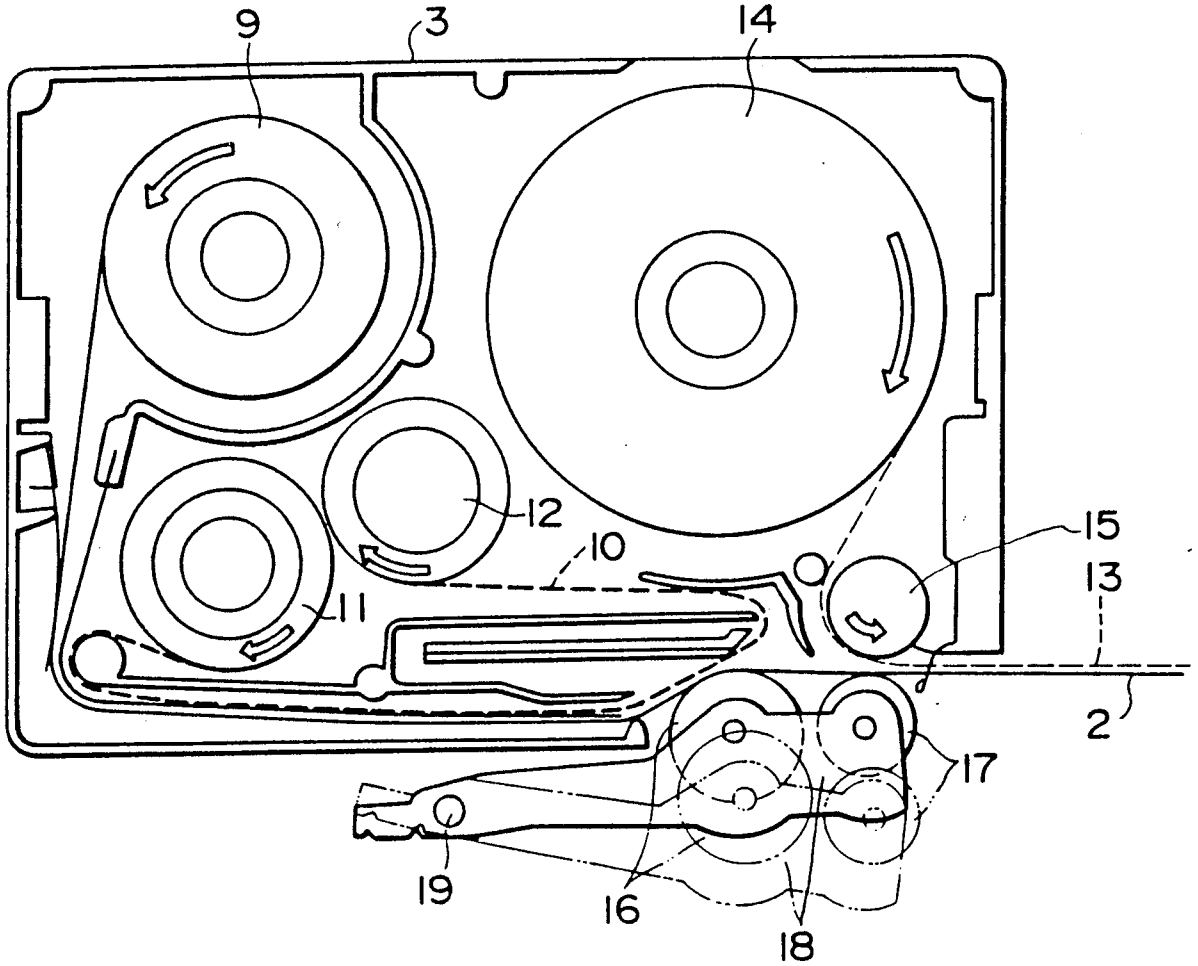
FIG. 2 is a partial sectional view showing the printing section of the printing device according to the present invention.

Referring to FIGS. 1 through 3, an embodiment according to the present invention will be described hereinafter.

As illustrated in FIG. 1, on the rear side of a printing device 1, a holding section 4 arranged so as to attach a tape holding case 3 housing a blank printing tape 2 therein is formed. As illustrated in FIGS. 1 and 2, the holding section 4 is provided with a ribbon wind up cam 5 for winding up an ink ribbon 10 in the tape holding case 3 and a tape feed roller cam 6 for sending the blank printing tape 2 from the inside of the tape holding case 3. On the other hand, the holding section 4 is provided with a thermal head 7 for printing character and/or symbol data on the blank tape 2 having been sent from the tape holding case 3 so that when the tape holding case 3 is attached, it is placed at an opening section 8 of the tape holding case 3.

As illustrated in FIG. 2, the tape holding case 3 houses a tape roll 9 where the blank printing tape 2 is wound in a rolled shape, a ribbon roll 11 where the ink ribbon 10 is wound in the rolled shape, the ink being transferred to the blank printing tape 2, a ribbon wind up spool 12 for winding up the ink ribbon 10, and a double-sided adhesive tape roll 14 for winding up a double-sided adhesive tape 13 which is arranged to be adhered to the back surface of the printing tape 2 on which the printing operation has been executed. On the other hand, the tape holding case 3 houses a tape feed spool 15 in the vicinity of the opening section 8 for feeding the printing tape 2 to the outside of the tape holding case 3 and for adhering the double-sided adhesive tape 13 on the rear surface of the printing tape 2.

When the tape holding case 3 is attached on the holding section 4, the ribbon wind up cam 5 and the tape feed roller cam 6 are functionally connected to the ribbon wind up spool 12 and the tape feed spool 15, respectively. In a printing state in which a printing operation is executed, the ribbon wind up spool 12 and the tape feed spool 15 are driven to be rotated. At this time, the printing tape 2 is fed out of the tape holding case 3 by a platen roller 16 and a tape feed roller 17 described later.

A mechanism for pressurizing the blank printing tape 2 to the thermal head 7 so as to print data on the blank printing tape 2 will be described hereinafter.

In the printing device according to the present invention, as illustrated in FIG. 2, the thermal head 7 is opposed to the platen roller 16. The tape feed spool 15 is opposed to the tape feed roller 17. These two rollers 16 and 17 are rotatably supported by a roller holder 18. The roller holder 18 is rockingly mounted about a holder shaft 19.

In the printing state where the tape holding case 3 is attached to the holding section 4, the platen roller 16 and the tape feed roller 17 are placed in the printing position shown with a solid line of FIG. 2, with the platen roller 16 and the tape feed roller 17 pressurizing the printing blank tape 2 against the thermal head 7 and the tape feed spool 15, respectively. When the tape holding case 3 is attached or detached, the roller holder 18 is placed in the release position shown with a two dot line of FIG. 2. Thus, the pressurizing operation by means of the platen roller 16 and the tape feed roller 17 is released.

Figure 3A:
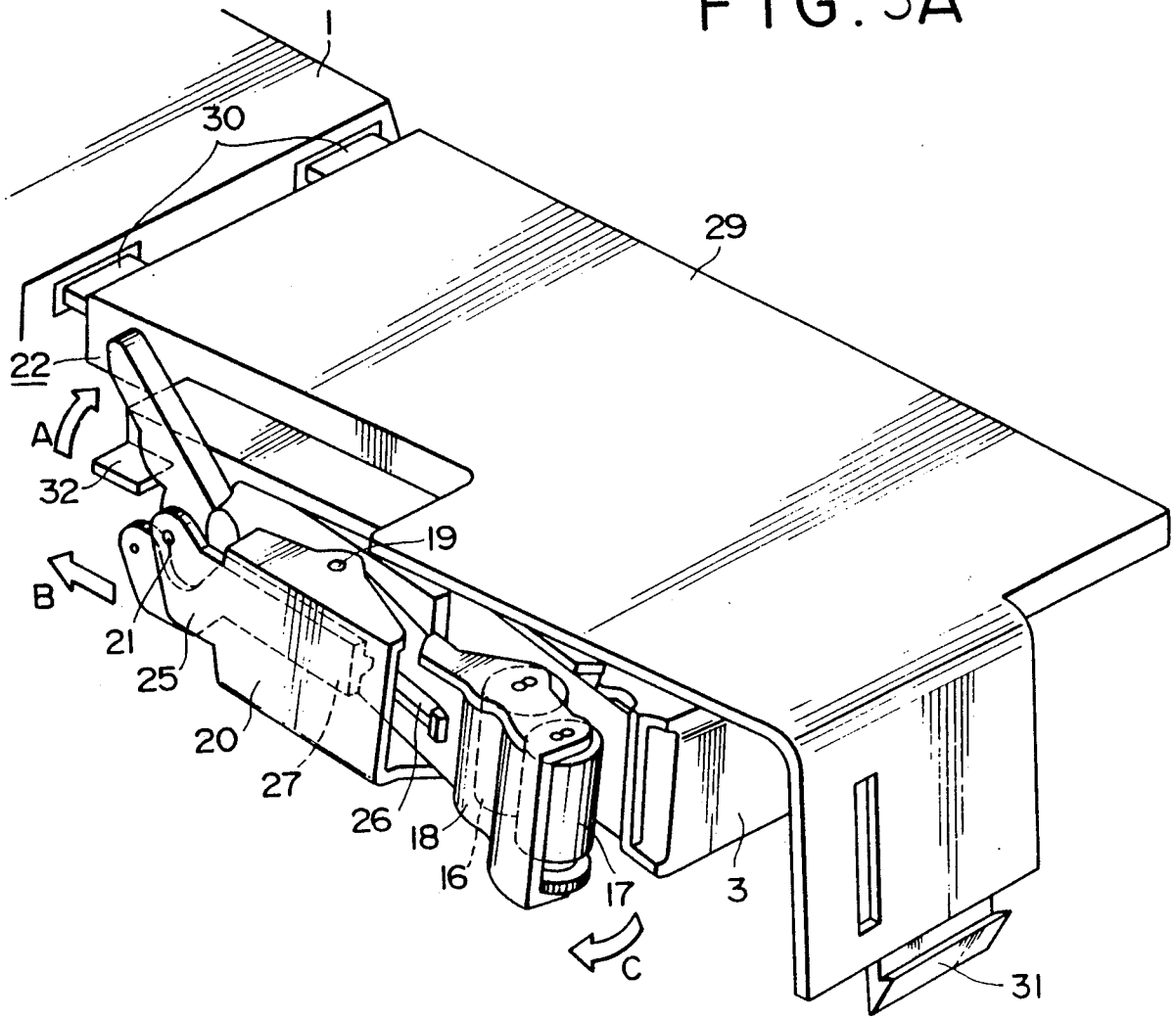
FIGS. 3A and 3B are perspective views showing the printing section of the printing device according to the present invention.
Figure 3B:
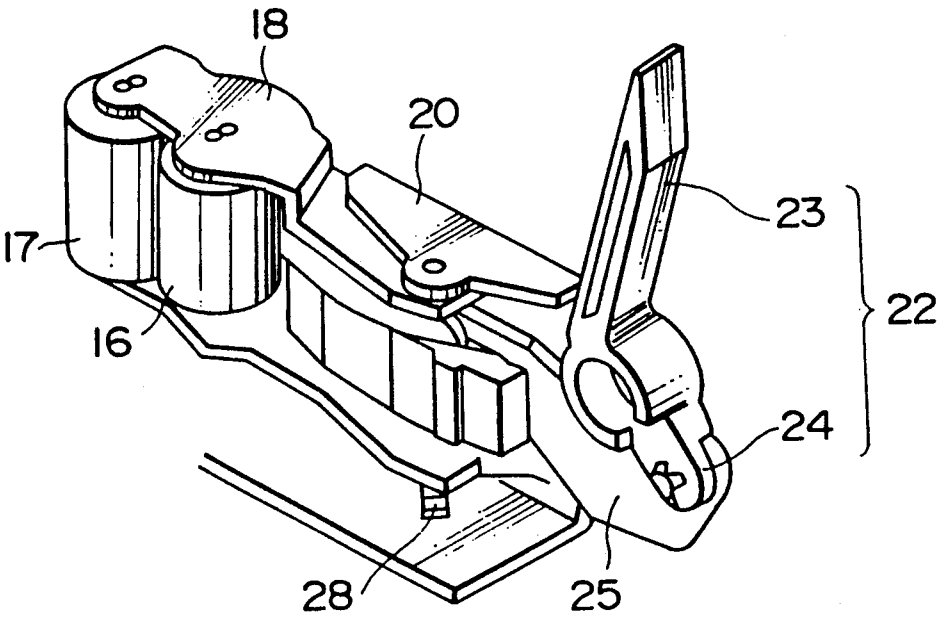

Referring to FIGS. 3A and 3B, a mechanism for alternating the roller holder 18 between the printing position and the release position will be described hereinafter.

The roller holder 18 is rockingly mounted on a frame 20 about the holder shaft 19. The frame 20 is fixed to the printing device 1 by means of a well-known member, not shown. At one end of the frame 20, a lever shaft 21 is fixed. About the lever shaft 21, a base section of a release lever 22 is rotatably supported. The release lever 22 is provided with a lever operation section 23 that an operator operates and a lever end section 24 extended in a reverse direction of the lever operation section 23 against the base section of the release lever 22. At the lever end section 24, a roller release rod 25 is movably supported in accordance with the operation of the lever operation section 23. When operating the lever operation section 23, the roller release rod 25 accordingly moves. The roller release rod 25 is disposed between the roller holder 18 and the frame 20. By the operation of the lever operation section 23, the roller release rod 25 slidably and pressingly moves on the rear surface of the roller holder 18, i.e., the front of drawing of FIG. 3A. A protruded section 27 at the end of the roller release rod 25 is guided to the slide groove 26 and thereby a smooth sliding operation of the roller release rod 25 takes place. The roller holder 18 is biased to the roller release rod 25 located behind the roller holder 18 by a toggle spring 28 mounted on the holder shaft 19.

As illustrated in FIG. 3A, when rotating the lever operation section 23 in a direction indicated by an arrow "A", the roller release rod 25 accordingly moves in a direction indicated by an narrow "B". Thus, a gap is formed between the roller holder 18 and the frame 20. The roller holder 18 is moved in a direction indicated by an arrow "C" by the pressurizing force of the toggle spring 28. When placing the lever operation section 23 in the reverse direction of the arrow "A", the roller release rod 25 is moved in the reverse direction of the arrow "B". Thus, the end of the roller release rod 25 is entered between the roller holder 18 and the frame 20. Thus, the roller release rod 25 pressurizes the rear surface of the roller holder 18, so that the roller holder 18 moves to the reverse direction of the arrow "C".

Consequently, by operating the release lever 22, the roller holder 18 can be moved between the printing position and the release position.

A case cover 29 which covers the tape holding case 3 on which the tape cassette 3 is attached to the holding section 4 of the printing device 1 will be described hereinafter.

The case cover 29 is provided with a concave piece 30 and a hook piece 31 which are respectively fastened to the printing device 1.

When the concave piece 30 is inserted into a hole of the printing device 1 and the hook piece 31 is fastened to a fastening section, not shown, of the printing device 1, the case cover 29 is attached to the printing device 1.

The case cover 29 is provided with a tongue piece 32 which can be fastened to the lever operation section 23 of the release lever 22 described above. As illustrated in FIG. 3A, when the case cover 29 is attached to the printing device 1 and the lever operation section 23 is rotated in the reverse direction of the arrow "A", the tongue piece 32 is located below the lever operation section 23.

When the case cover 29 is removed from the printing device 1, the tongue piece 32 engages the lever operation section 23. When the case cover 29 is removed, the lever operation section 23 is rotated in the direction of the arrow "A". Thus, when removing the case cover 29, the lever operation section 23 can be placed in the release position. Consequently, the pressure and holding of the tape cassette by the roller holder 18 can be released.

Figure 4A:
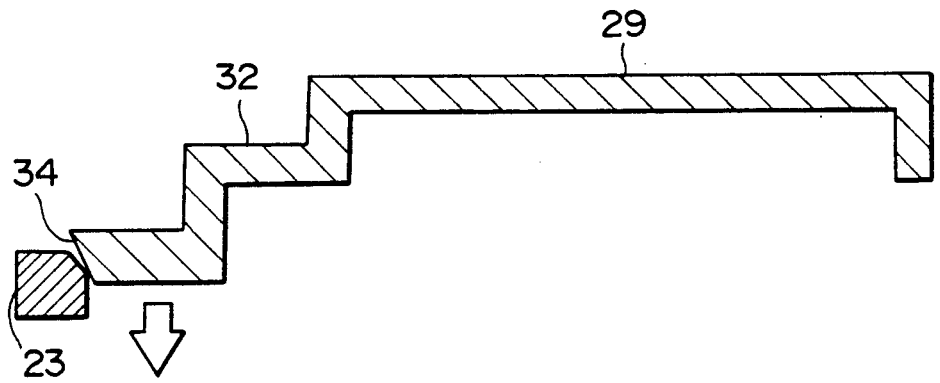
FIGS. 4A and 4B are sectional views respectively showing positional relationships between the case cover and the detaching mechanism for detaching the tape holding case from the printing device.
Figure 4B:
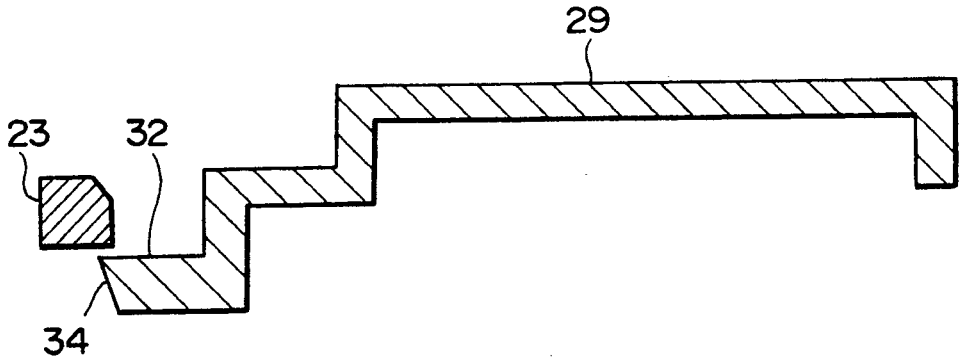

Further, as illustrated in FIGS. 4A and 4B, it may be considered that an inclined surface 34 is formed at the end of the tongue piece 32 where the tongue piece 32 is contacted with the lever operation section 23. The inclined surface 34 is inclined in such a manner that a lower surface at the end of the tongue piece 32 is cut from the upper surface thereof. While the lever operation section 23 is placed in the reverse direction of the arrow "A", when the case cover 29 is attached on the printing device 1, the tongue piece 32 is contacted with the lever operation section 23, as illustrated in FIG. 4A. However, since the lever operation section 23 is in contact with the inclined surface 34 of the tongue piece 32, when the case cover 29 is downwardly moved, the tongue piece 32 and the lever operation section 23 slightly moves in a horizontal direction so that they are separated from each other as shown in FIG. 4B. Thus, the case cover 29 can be attached to the printing device 1 without an interference with the lever operation section 23. In addition, the inclined surface 34 can be also disposed at the lever operation section 23. In addition, it may be considered that a mechanism for allowing the horizontal movement of the tongue piece 32 or the lever operation section 23 is provided to allow the tongue piece 32 or the lever operation section 23 to be easily moved.

As described above, the printing tape can be easily detached by detaching the tape holding case. When detaching the tape holding case, by opening the case cover, the pressurizing force having been applied by the thermal head and the platen roller and that by the tape feed roller and the tape feed spool against the printing tape are respectively released. Thus, it is not necessary to detach the tape holding case while pressed to the holding section. Consequently, damages of the printing tape, the tape holding case, and so forth can be prevented.

What is claimed is:

1. A printing device including a printing member for printing character and/or symbol data onto a printing tape; a printing tape; a case member arranged to be detachably mounted on said printing device for housing in a wound state at least printing tape on which a printing operation has not been executed; and a cover for said case member, said printing device further comprising:

a platen member;

supporting means for supporting said platen member spaced apart from and opposed to said printing member;

means for feeding said printing tape between said platen member and said printing member, said supporting means being rockable between a first position at which said printing member and said platen member form a nip for said printing tape and a second position at which said printing member and platen member do not form a nip; and controlling means for rocking said supporting means to said second position responsive to detachment of said case member cover from said printing device.

2. The printing device according to claim 1, wherein said printing member comprises a thermal head member.

3. The printing device according to claim 1 further comprising a shaft member and wherein said supporting means comprises a holder member for holding at least said platen member, said holder member being rockingly movable between at least said first position and said second position about said shaft member.

4. The printing device according to claim 3, wherein said controlling means comprises a lever member movable between at least two positions respectively corresponding to said first and second positions and said controlling means further comprises a release rod member connected to said lever and engaging a portion of said holder member, said rod being slidable along said holder member in response to movement of said lever member; said lever member including means in operable contact with said cover member whereby said lever member is moved to a position to move said holder member to said second position in response to a detachment of said cover member from said printing device.

5. The printing device according to claim 4 further comprising an inclined surface formed on at least one of a portion of said cover member and said lever member, said inclined surface providing a cam to move said cover member and lever member.

6. The printing device according to claim 4, which further comprises a pair of feed rollers for said printing tape and means for bringing said pair of rollers into and out of nip with each other in response to movement of said holder member, one of said rollers being provided on said case member and the other of said rollers being provided on said holder member, said rollers being operable to feed said printing tape immediately after a printing operation has been executed thereon.

7. A printing device, capable of utilizing at least a printing tape on which a printing operation is to be executed, including a printing member for executing the desired printing operation on said printing tape, and a case member arranged to be detachably mounted on said printing device for housing in a wound state printing tape on which a printing operation has not yet been executed, said printing device further comprising:

a platen member;

supporting means for supporting said platen member, spaced apart from said printing member, means for feeding said printing tape between said platen member and said printing member;

controlling means for controlling said supporting means so as to be movable between a first position in which said printing tape is nipped between said printing member and said platen member and a second position in which the nipping of said printing tape is released; and another controlling means detachably provided on said printing device, said another controlling means comprising means to move said supporting means to said second position responsive to detachment of said another controlling means from said printing device.

8. The printing device according to claim 7, wherein said printing member comprises a thermal head member.

9. The printing device according to claim 7 further comprising a shaft member and wherein said supporting means comprises a holder member for holding at least said platen member, said holder member being rockingly movable between at least said first position and said second position about said shaft member.

10. The printing device according to claim 9, wherein said controlling means comprises a lever member movable between at least two positions respectively corresponding to said first and second positions; and a release rod member engaging a portion of said holder member said rod being slidable along said holder member in response to movement of said lever member whereby said holder member is movable between said first and second positions in response to operation of said lever member.

11. The printing device according to claim 10, wherein said another controlling means comprises a cover member arranged to be detachably provided on said printing device to cover at least said case member, said cover member having a position engageable with said lever member when said cover member is detached from said printing device.

12. The printing device according to claim 11, wherein said cover member and said lever member are perpendicularly moved to a direction along which said lever member is moved when said cover member is attached to said printing device and said lever member is located at the position corresponding to said first position.

13. The printing device according to claim 12 further comprising an inclined surface formed on at least one of said position of said cover member and said lever member, said inclined surface provided a cam to move said cover member and lever member.

14. The printing device according to claim 10, which further comprises a pair of feed rollers for said printing tape said pair of rollers being arranged to be brought into and out of contact with each other in accordance with a moving operation of said holder member and each of said pair of rollers respectively being provided on said case member and said holder member, said rollers being operable to feed said printing tape immediately after a printing operation has been executed thereon.

* * * * *